United States Patent [19]

Salandre

[11] Patent Number: 4,934,574

[45] Date of Patent: Jun. 19, 1990

[54] HANDGUN HOLSTER AND RETENTION APPARATUS

[76] Inventor: Stephen M. Salandre, P.O. Box 130, Taos, N. Mex. 87571

[21] Appl. No.: 428,890

[22] Filed: Oct. 30, 1989

[51] Int. Cl.[5] ..... F41C 33/02

[52] U.S. Cl. ..... 224/244; 224/911

[58] Field of Search ..... 224/244, 243, 242, 911, 224/912, 193

[56] References Cited

U.S. PATENT DOCUMENTS

| | | | |
|---|---|---|---|
| 468,556 | 2/1892 | Anderson . | |
| 1,113,530 | 10/1914 | Audley . | |
| 1,851,352 | 3/1932 | Denkert . | |
| 1,951,865 | 3/1934 | Franz . | |
| 2,109,734 | 3/1938 | Preneta | 224/244 |
| 2,349,376 | 5/1944 | Ray . | |
| 2,577,869 | 12/1951 | Adams | 224/243 |
| 3,645,428 | 2/1972 | Angell . | |
| 3,718,240 | 2/1973 | Rose | 224/243 |
| 4,256,243 | 3/1981 | Bianchi et al. . | |
| 4,277,007 | 7/1981 | Bianchi et al. . | |

*Primary Examiner*—Linda J. Sholl

*Attorney, Agent, or Firm*—Henderson & Sturm

[57] ABSTRACT

A handgun holder and retention apparatus for use in combination with a handgun having a trigger and a trigger guard surrounding the trigger. A holster body defines a pocket for holding such handgun and includes a region of the body which encloses the trigger guard of the handgun when the handgun is positioned in the holster body. An opening is provided through the inner side of the holster body and a slot extending through the outer side of the holster body has an open top. A detent is provided for extending through the opening and through the trigger guard for preventing unauthorized access to the handgun. A leaf spring apparatus is attached to the bottom thereof to the inner side of the holster body below the opening and is connected to one end of the detent at the top thereof for biasing the detent into the opening and into the trigger guard on the handgun. A downwardly extending lip is disposed on the other end of said detent. A second biasing device is operatively connected to said holster body for biasing the handgun upwardly to cause the downwardly extending lip to be disposed on the outward side of the lower portion of said trigger guard whereby the detent cannot be readily pushed out of the trigger guard until the handgun is pushed downwardly.

4 Claims, 3 Drawing Sheets

HANDGUN HOLSTER AND RETENTION APPARATUS

TECHNICAL FIELD

The present invention relates generally to a handgun holster and retention apparatus for preventing unauthorized access to a handgun disposed therein and more particularly to such an apparatus having an adjustable leaf spring mechanism associated therewith.

BACKGROUND ART

In the law enforcement field it is important to have ready access to a handgun but it is equally as important to prevent someone confronted by a law enforcement officer from gaining access to such handgun. This problem has been well known for years and attempts have been made to solve the problem, such as by providing a strap over the top of the handgun which snaps to the holster, for example. This solution simply does not provide a sufficient deterrent to the aforementioned problem.

U.S. Pat. No. 3,645,428 to Angell uses a holster which snaps open in front which is a fairly common construction and does not fully address the aforementioned problem. U.S. Pat. No. 2,349,376 to Ray shows a structure which may tend to interfere with the release of the handgun during draw. If a twisting motion is applied during an unauthorized access, the captured segment of the trigger guard could get past the apparatus used to prevent it, thereby resulting in successful acquisition of the pistol by unauthorized personnel. U.S. Pat. No. 4,256,243 to Bianchi et al uses a hesitation lock but this lock could be actuated by using the right knee, for example, thereby releasing the weapon into the left hand. U.S. Pat. No. 4,277,007 to Bianchi et al shows an apparatus which will not work with revolvers, i.e. handguns having protruding cylinders. Consequently, such a device simply is not universally adaptable to enough handguns to make it a practical device. Consequently, while the aforementioned problem has been addressed, the prior art simply does not solve the problem in an economical and straightforward way.

DISCLOSURE OF THE INVENTION

The present invention relates to a handgun holder and retention apparatus for use in combination with a handgun having a trigger and a trigger guard surrounding the trigger. A holster body defines a pocket for holding such handgun and includes a region of the body which encloses the trigger guard of the handgun when the handgun is positioned in the holster body. An opening is provided through the inner side of the holster body and a slot extending through the outer side of the holster body has an open top. A detent is provided for extending through the opening and through the trigger guard for preventing unauthorized access to the handgun. A leaf spring apparatus is attached to the bottom thereof to the inner side of the holster body below the opening and is connected to one end of the detent at the top thereof for biasing the detent into the opening and into the trigger guard on the handgun. A downwardly extending lip is disposed on the other end of said detent. A second biasing device is operatively connected to said holster body for biasing the handgun upwardly to cause the downwardly extending lip to be disposed on the outward side of the lower portion of said trigger guard whereby the detent cannot be readily pushed out of the trigger guard until the handgun is pushed downwardly.

An object of the present invention is to provide an improved handgun holder and retention apparatus.

Another object of the present invention is to provide a handgun holder and retention apparatus which prevents unauthorized access to the handgun disposed therein while at the same time permitting the user to have ready access to such handgun.

Another object of the present invention is to provide an apparatus of the aforementioned type which includes an adjustable leaf spring so that the force biasing the detent into the trigger guard can be adjusted to the user's requirements.

Another object of the present invention is to provide a lip on the detent and a biasing mechanism to push the handgun up to make it difficult to move the detent from the trigger guard until and unless the handgun is pushed down against the pressure of the biasing mechanism.

Other objects, advantages, and novel features of the present invention will become apparent from the following detailed description of the invention when considered in conjunction with the accompanying drawings.

BEST MODE FOR CARRYING OUT THE INVENTION

Figure 1:
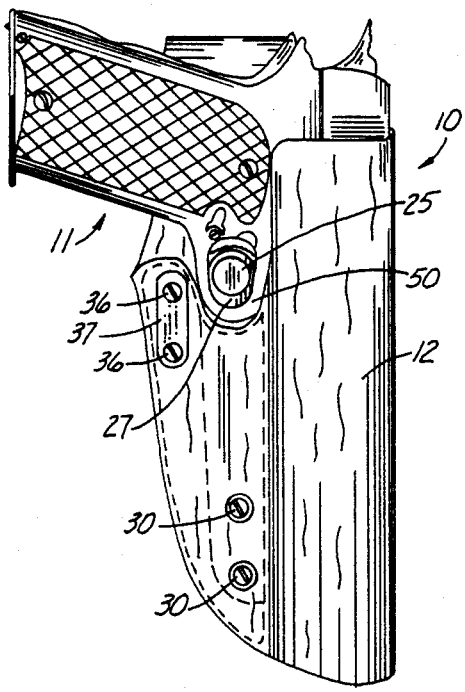
FIG. 1 is a side elevational view of the present invention having a handgun disposed in a holster.
Figure 2:
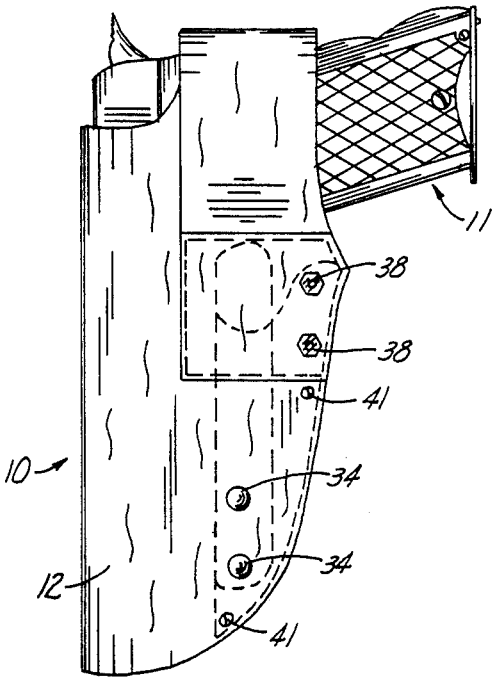
FIG. 2 is the opposite side elevational view from FIG. 1.
Figure 3:
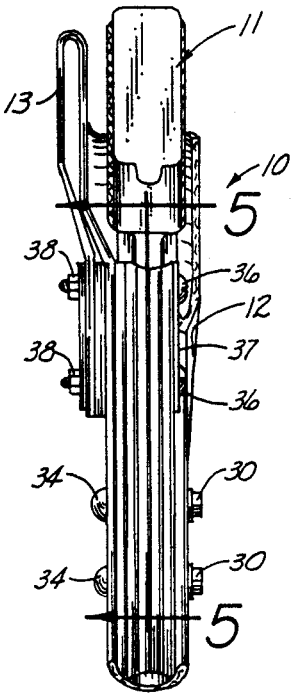
FIG. 3 is a rear view of the structure shown in FIG. 1.
Figure 9:
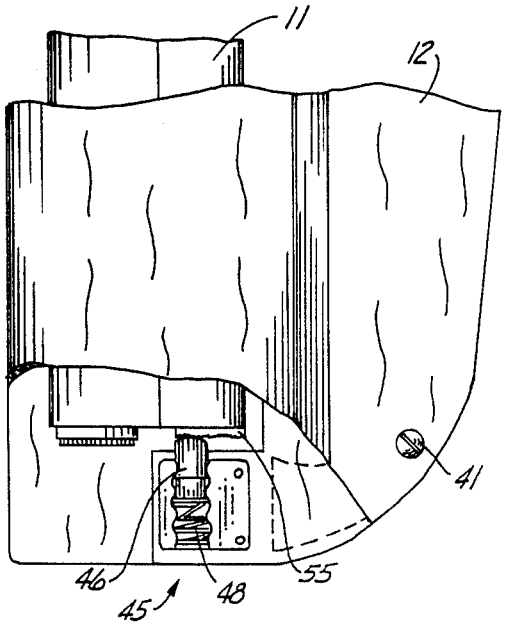
Figure 4:
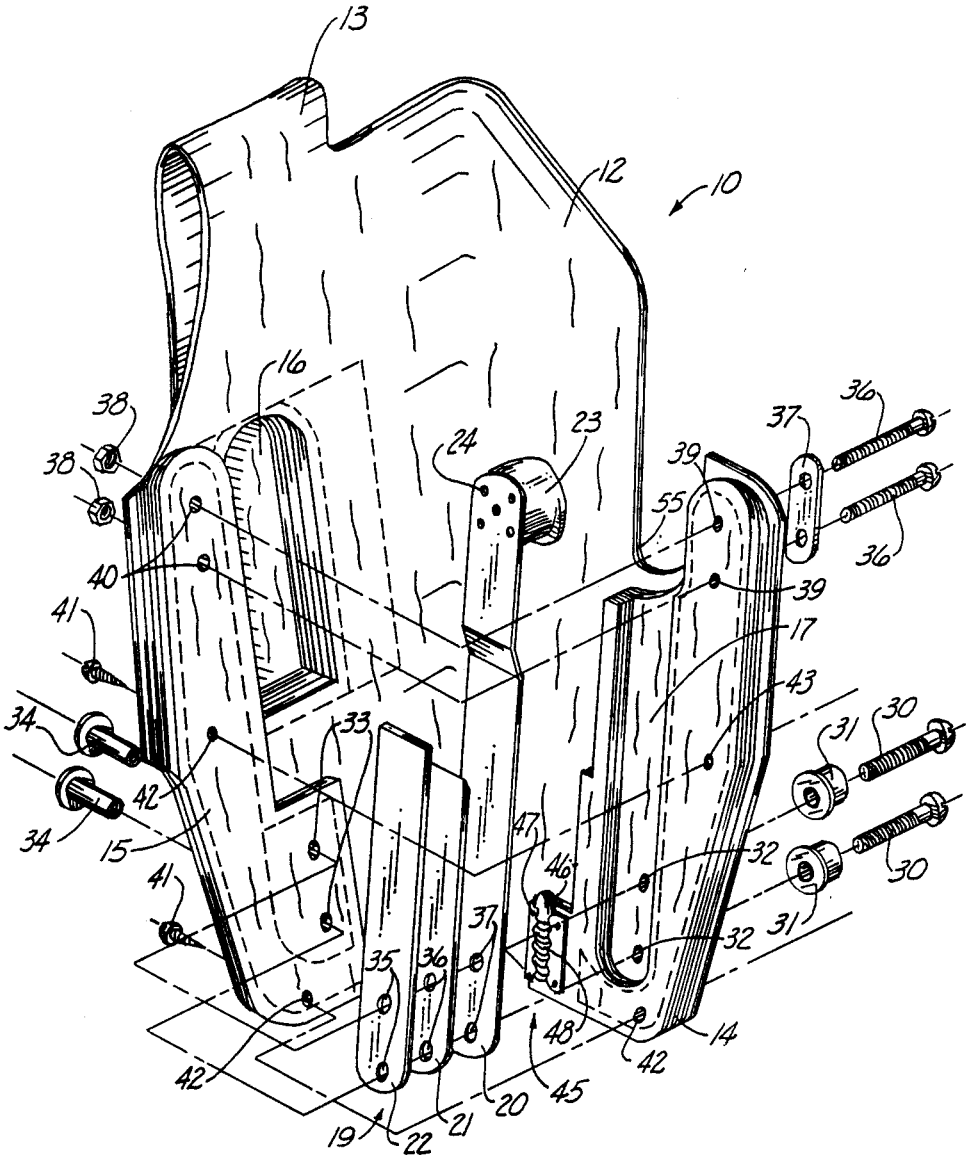
FIG. 4 is an exploded view of the holster mechanism of the present invention.
Figure 5:
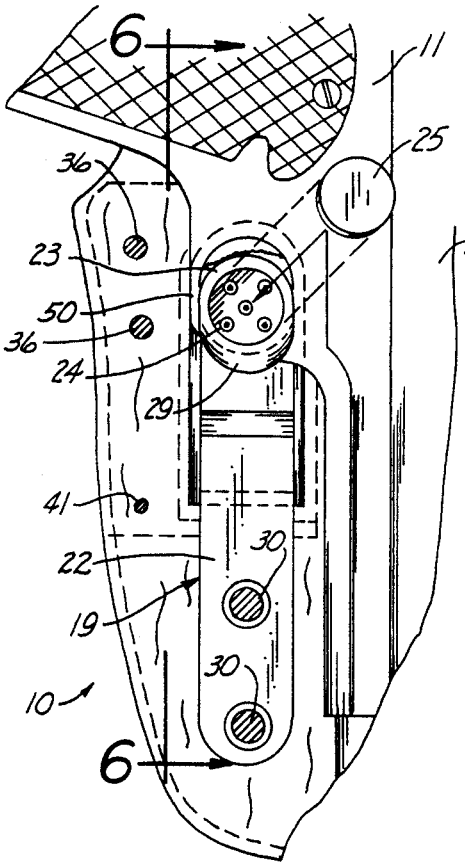
FIG. 5 is an enlarged partial cross sectional view taken along line 5—5 of FIG. 3.

Referring now to the drawings wherein like reference numerals designate identical or corresponding parts throughout the several views, FIG. 1 shows a holster apparatus (10) constructed in accordance with the present invention and having a handgun (11) disposed therein. The holster (10) has a leather body (12) with a loop (13) thereon for receiving a belt therethrough. The leather body (12) has layers of spacer leather (14) and (15) thereon. An opening (16) is disposed on one side of the holster and an opening (17) is disposed on the other side of the holster within the layers (14). A plurality of leaf springs (20), (21) and (22) constitute a first biasing structure (19). If less pressure is desired, one or more of springs (21) and (22) can be removed. If more pressure on detent (23) is desired, more leaf springs like (21) and (22) can be added. The biasing structure (19) has a detent (23) riveted to the top of leaf spring (20) by rivets (24). A rubber pad (25) as is best shown in FIG. 5, is placed on one end of the detent (23) over the rivets (24) to reduce wear and tear on the finger (26) shown in FIG. 8 used to push on the detent.

Bolts (30) extend through washers (31) and openings (32) and (33) in the holster body (12) and threadably engage fasteners (34). These bolts (30) also extend through openings (35), (36) and (37) in leaf springs (20), (21) and (22) to firmly hold the bottom of the first biasing mechanism (19) in place in the holster body (12). Bolts (36), washer (37) and nuts (38) extend through openings (39) and (40) in the holster body (12) to hold the top of the holster in place. A screw (41) extends through openings (42) and (43) for holding the central part of the holster body parts together.

A plunger assembly (45) is disposed in the bottom of the holster body (12) and includes a piston (46) which is slidably received in opening (47). A compression spring (48) abuts the bottom of the holster at one end and abuts the pistons (46) at the other end. The top of the spring is connected to the piston (46) by a screw (not shown).

Figure 6:
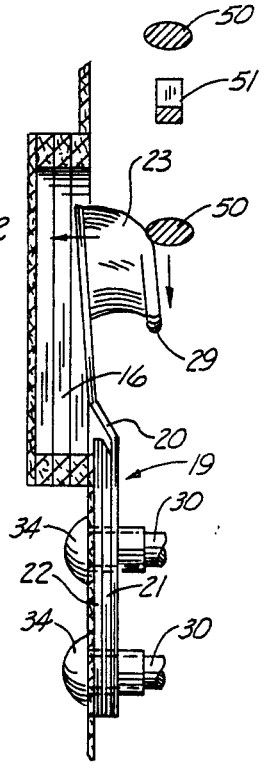
FIG. 6 is a partial enlarged cross sectional view taken along line 6—6 of FIG. 6 and showing how the handgun is inserted into the holster.
Figure 7:
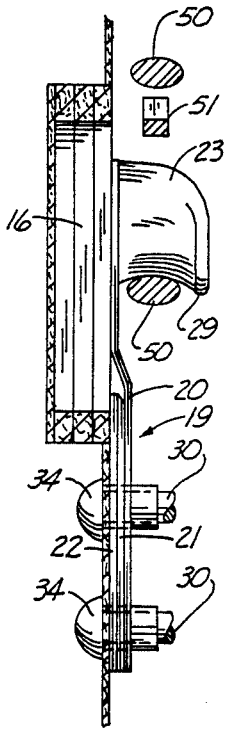
FIG. 7 shows a view like FIG. 6 but showing how the handgun is held into the holster to prevent unauthorized removal therefrom.

In operation, the handgun (11) can be inserted into the holster (10) by merely pushing it downwardly in ordinary fashion as shown in FIG. 6. As the handgun (11) is pushed downwardly, a trigger guard (50) will contact the top rounded portion of the detent (23) and the detent (23) will be pushed to the left as viewed in FIG. 6 to allow the lower portion of the trigger guard (50) to pass passed the detent (23). The handgun (11) is pushed far enough so that the bottom of the barrel (55) contacts the piston (46) and then the handgun (11) is further pushed so that the piston is pushed downwardly to the extent that the bottom portion of the trigger guard (50) passes below the lip (29) of the detent (23). Once that happens, the detent (23), which is biased to the right as shown in FIG. 6, will slide into the trigger guard (50) just below the trigger (51) as is shown in FIG. 7.

If an unauthorized user attempts to remove the handgun (11) from the holster (10), the initial impulse will be to merely pull the handgun (11) upwardly. This will be prevented because the detent will prevent an upward movement of the handgun (11). Even if such unauthorized user notices the detent (23), and attempts to push on it to release the handgun (11), this will be extremely difficult, if not impossible, because the piston (46) is biasing the lower portion of the trigger guard (50) upwardly to the position shown in FIG. 7 whereby the lip (29) will prevent the handgun (11) from being removed.

Figure 8:
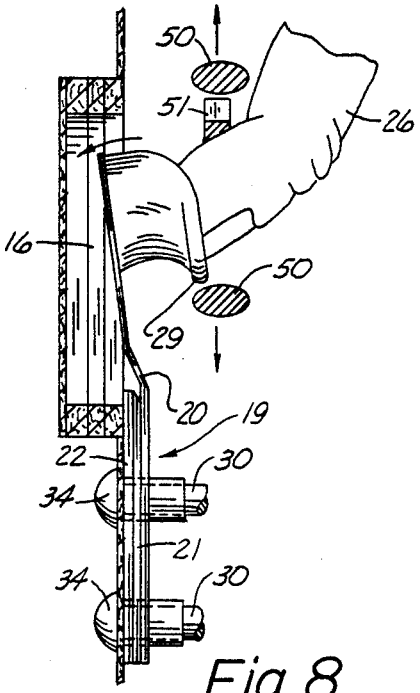
FIG. 8 is a view like FIG. 6 and 7 but showing how the handgun is removed by authorized personnel by first pushing down on the handgun to cause the trigger guard to go below the lip on the detent and then to pull the handgun upwardly after the detent has been pushed out of the trigger guard.

On the other hand, if the authorized user of the handgun which would be the person wearing the holster (10), wishes to use the handgun (11), the process is extremely quick and simple once the operation of the device is known to the user. The user would merely push down on the top of the handgun (11) for example as shown in FIG. 8, while at the same time using finger (26) to push the detent (23) to the left as viewed in FIG. 8. Once the lower portion of the trigger guard (50) clears the lip (29), the detent (23) will quickly move to the left as shown in FIG. 8 to permit the trigger guard to clear the detent (23) and the lip (29) thereon to allow the handgun (11) to be quickly removed.

Accordingly, it will be appreciated that the present invention does indeed accomplish the aforementioned objects. Obviously, many modifications and variations of the present invention are possible in light of the above teachings. It is therefore to be understood that, within the scope of the appended claims, the invention may be practiced otherwise than as specifically described.

I claim:

1. A handgun holder and retention apparatus for use in combination with a handgun having a trigger and a trigger guard, including an upper and lower portion thereof surrounding said trigger, said apparatus comprising:

a holster body means defining a pocket for holding a handgun and including a region of the body means which encloses the trigger guard of said handgun when positioned in the holster body means, said holster body means including an outer side and an inner side adapted to abut a user's side;

an opening extending through the inner side of the holster body means at said trigger guard region;

a slot extending through the outer side of the holster body means at said trigger guard region, said slot having an open top;

detent means for extending through said opening and through said trigger guard;

first biasing means connected to one end of said detent means and to said holster body means for biasing said detent means into said opening;

a downwardly extending lip disposed on the other end of said detent means; and second biasing means operatively connected to said holster body means for biasing said handgun upwardly to cause said downwardly extending lip to be disposed on the outward side of the lower portion of said trigger guard whereby said detent means cannot be readily pushed out of said trigger guard until said handgun is pushed downwardly.

2. The apparatus of claim 1 wherein said first biasing means includes a leaf spring connected at the bottom thereof to said holster body means and at the top thereof to said one end of the detent means.

3. The apparatus of claim 1 wherein said second biasing means includes a piston slidably disposed in an opening in the bottom of said holster body means and a compression spring having one end in contact with said holster body means and the other end in contact with said piston whereby said piston will be in contact with said handgun when said handgun is fully disposed in said holster body means.

4. The apparatus of claim 1 wherein a resilient pad is disposed on said other end of said detent means for padding the portion of said detent means which is contacted by a user's finger to push said detent means from said trigger guard.

* * * * *